United States Patent [19]

Smith

[11] Patent Number: 4,803,909

[45] Date of Patent: Feb. 14, 1989

[54] APPARATUS AND METHOD FOR AUTOMATED BRAIDING OF SQUARE ROPE AND ROPE PRODUCT PRODUCED THEREBY

[76] Inventor: Michael F. Smith, 19534 55th Ave., N.E., Seattle, Wash. 98155

[21] Appl. No.: 37,332

[22] Filed: Apr. 13, 1987

[51] Int. Cl.[4] ..... D04C 1/12; D04C 3/06; D04C 3/12

[52] U.S. Cl. ..... 87/6; 87/8; 87/29; 87/50

[58] Field of Search ..... 87/1, 5–8, 87/28–30, 31, 44, 50

[56] References Cited

U.S. PATENT DOCUMENTS

| | | | |
|---|---|---|---|
| 1,361,803 | 12/1920 | Ashley | 87/8 |
| 1,771,912 | 7/1930 | Blaisdell | 87/6 |
| 2,469,178 | 5/1949 | Salvans | 87/6 |
| 3,078,755 | 2/1963 | Chace, Jr. | 87/6 X |
| 3,124,032 | 3/1964 | Webster et al. | 87/6 X |
| 3,323,406 | 6/1967 | Mitchell | 87/6 X |
| 3,805,667 | 4/1974 | Orser | 87/6 |
| 4,256,011 | 3/1981 | Kozlowski | 87/6 |

*Primary Examiner*—John Petrakes
*Attorney, Agent, or Firm*—Larry A. Jackson

[57] ABSTRACT

An apparatus automatically braids a plurality of rope forming strands onto a center core member in a braiding pattern that causes the resulting rope to have a generally square shaped cross section. The braiding strands are fed to a braiding point on the center core member from a plurality of eight strand feed assemblies which are transported on a mechanism in two distinct but crossing orbits that encircle the center core member. The constituent strands are themselves formed by pre-braided or pretwisted substrands or filaments to cause the resulting rope to exhibit pronounced ribs along the corners of the square cross section for a secure hand-to-rope grip.

20 Claims, 9 Drawing Sheets

72d
72c
72a
6
7
8
5
2
3
1
22
25

Fig. 24.
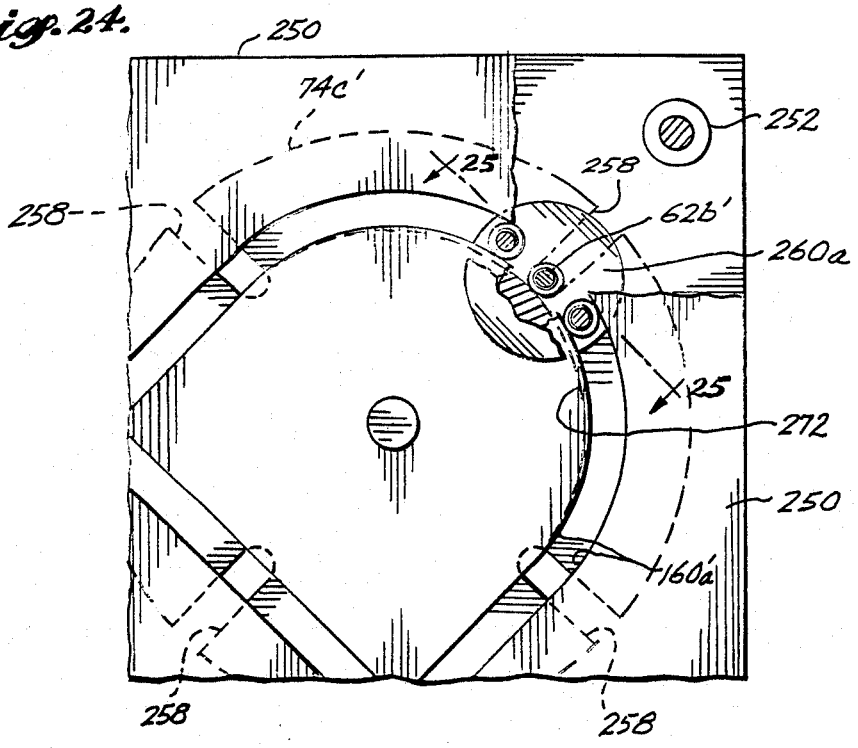
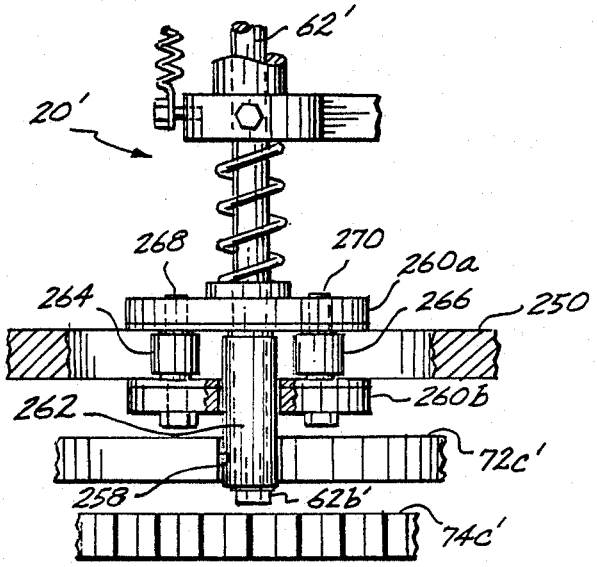
Fig. 25.

APPARATUS AND METHOD FOR AUTOMATED BRAIDING OF SQUARE ROPE AND ROPE PRODUCT PRODUCED THEREBY

BACKGROUND OF THE INVENTION

The present invention pertains to rope braiding apparatus and methodology, and in particular pertains to automated manufacture of commercial grade rope and sheathing having a square shaped cross section.

Square rope made by hand has been known and used since the 15th century. Despite numerous advantages in special applications, such rope has not been commercially available due to the expense of its manufacture, lack of uniform high quality tight braid, and practical limits on the length of rope when braided by hand. The hand braiding exhibits uneven, loose braids which decrease strength, contribute to rapid wear and in general detract from the usefulness and commercial acceptability.

One of the significant advantages of such rope is in the secure hand-to-rope grip provided by the square shape which tends to better fit the human hand. Thus applications in which ropes are handled can use this product to advantage. Safety lines, marine mooring lines, and mountaineering rope in particular provide good examples of important uses of this type of rope. Other applications include hoisting or other similar situations in which one end of the rope is free to rotate and excessive twisting may occur. The square shaped configuration resists twisting and causes the rope to return to a neutral untwisted state. The braided rope may be formed as a sheath and used to cover guy wire, conduit, hose or other similar article that needs to be gripped securely. Other advantages and special applications are noted below.

In the prior art of hand braiding square rope, it is necessary to first provide a plurality of cut strands which are then laid out lengthwise and worked into the braiding point by hand. The difficulty of working with the numerous strands, a minimum of eight separate strands are required, limits the practical length of the resulting rope to about thirty feet. An attempt to hand braid ropes of greater length results in the impossible task of managing the constituent strands. Furthermore, such hand braided rope does not, as a practical matter, accommodate a center strand or other center core, such as a hose. The nature of the square shaped braiding process results in a rope that will tend to stretch more than other types of braided rope and hence the center strand, if it can be incorporated into the rope, serves to greatly resist such stretching and produce a more usable and practical rope product. In other applications where a hollow rope braid is desired, as in the case of sheathing mentioned above, hand braiding closes on the center, making it unsuitable as a sheath.

Another rope forming process which is related, but should not be confused with the hand braided square rope process, is known as the crown knot. A series of such knots are formed from a set of four rope strands. The resulting product does have a generally square shaped exterior. However, the configuration of the knot forming process is entirely different from a braided rope that is the subject matter of this invention and does not have the advantages and capabilities of a true square braided rope.

SUMMARY OF THE INVENTION

Thus, in accordance with the present invention, an apparatus and process are provided for braiding square rope in an automated process that produces the rope product at commercially acceptable lengths and per unit costs, and with a uniformity of braid that makes it saleable to industrial, marine, and sportsman users. The automated process essentially comprises apparatus and method for feeding a core or center member along a lengthwise path relative to a support table and transporting a plurality of strand feed assemblies, e.g. bobbins, in crossing travel orbits around the axis of the center core. The strand feed assemblies which include spools, bobbins or other wound supply strands are transported in the crossing travel orbits so as to produce the following characteristic braiding pattern.

A minimum of eight strand assemblies are used and a set of one half of these are mounted to travel in a first orbit and the remaining half are transported in a second counter travel orbit that crosses the first orbit at four exchange or crossing points. The crossing pattern of the orbits is such that the strand feed assemblies traveling in the first orbit pass outside of the orbiting second set of assemblies in diametrically opposing sectors of travel, and the assemblies traveling in the second orbit similarly pass outside of the first orbiting assemblies in another set of diametrically opposing and complementary sectors. As a result of these crossing orbits, a rope is produced in which the corners of the square shaped configuration are formed by ribs of closely packed, parallel outer strand segments that in pairs pass over one inner strand segment. The parallel edge forming outer segments lie diagonally to the rope axis and the inner segment has an opposite diagonal orientation relative to the rope axis. Each inner strand emerges from a midside of the rope to join with other similarly emerging strands to form the closely packed, parallel outer segments of the adjacent corner of the rope.

In one preferred embodiment of the invention, a transport mechanism of four coplanar and synchronously rotating disks arranged symmetrically about the rope formation axis, and in which adjacent pairs of disks are counter rotating, carry the strand assemblies in the above described crossing orbits. A disk to disk transfer operation causes the assemblies to alternately travel around the outer and inner perimeters of different disks. By this arrangement, the two counter-rotating orbital patterns are of essentially oval shape, pinched at the center. As the strand feed assemblies are being transported in their orbits and feeding strands to the braiding point on the lengthwise moving center core member, a take-off mechanism frictionally grips the rope downstream of the braiding point and applies a continuous pull or tension force on the rope and constituent strands. This take-off tension is counteracted by the opposing tensions of all of the constituent strands fed from the orbiting strand feed assemblies. The radially outermost travel of the orbiting strand feed assemblies create the highest braiding tension to thereby produce a uniform, tight braid that insures a high quality rope product.

In an alternative embodiment, the strand feed assemblies are transported by the four synchronously rotating disks underlying a platform having crossing, oval tracks that confine the travel of the strand feed assemblies to the crossing orbits mentioned above. The transport mechanism in this case produces the same braiding pattern as mentioned above, however, the orbiting speed exceeds that of the above described embodiment.

Preferably the rope strands are prebraided or pretwisted and are made of a durable, weather resistant light weight fiber such as polyolefin. By using such a polyolefin fiber braided in accordance with the process of this invention, a rope of exceptional strength to weight ratio is obtained. The square shaped cross section has the advantages mentioned above, such as the grippability when handled, as well as other advantages such resistance to abrasion because the wear is distributed over a larger area, namely the entire face of one flat side. When made with the central core, the resulting rope has a low stretch factor. The square cross section does not offer any more resistance than conventional round rope when fed through block and tackle or pulleys.

In another application in which the rope is used as a sheath or covering, the apparatus operates to braid the strands onto a special core member, such as a conduit, hose or the like, fed lengthwise through the braiding point. Alternatively, the strands are braided onto a stationary needle colinear with the rope formation axis, and the braided strands are pulled off the needle to leave a hollow core sheath.

BRIEF DESCRIPTION OF THE DRAWINGS

These and further objects, features and advantages of the invention will become apparent from reading the following detailed description in conjunction with the attached drawings.

FIG. 19 is a further diagrammatic view of the orbital patterns of travel of the strand feed assemblies resulting from the sequence of FIGS. 9–18, in which FIG. 19 illustrates first and second travel orbits arranged in a crossing pattern to form the generally square shaped cross section of the resulting rope.

FIG. 24 is an enlarged corner fragment of the mechanism of FIG. 23 showing the travel of a base of one of the strand feed assemblies around an outer perimeter of the oval track.

FIG. 25 is a vertical section of the assembly base and lower support rod portion cooperating with the oval track of FIG. 24.

DETAILED DESCRIPTION OF PREFERRED AND ALTERNATIVE EMBODIMENTS

Figure 1:
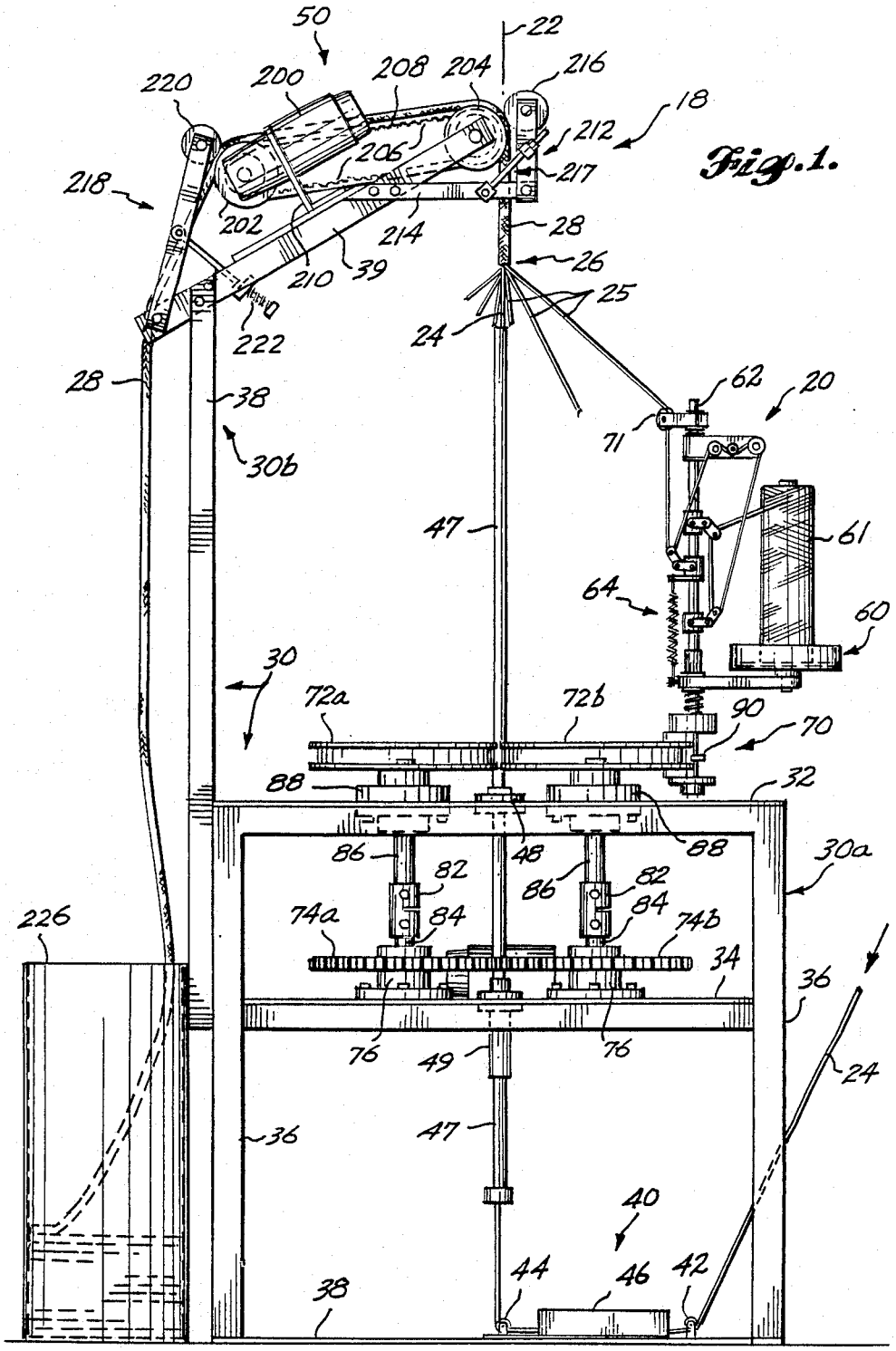
FIG. 1 is a side elevation view of the rope braiding apparatus constructed in accordance with a preferred embodiment of the invention, in which all but one of the orbiting strand feed assemblies have been omitted for clarity.
Figure 2:
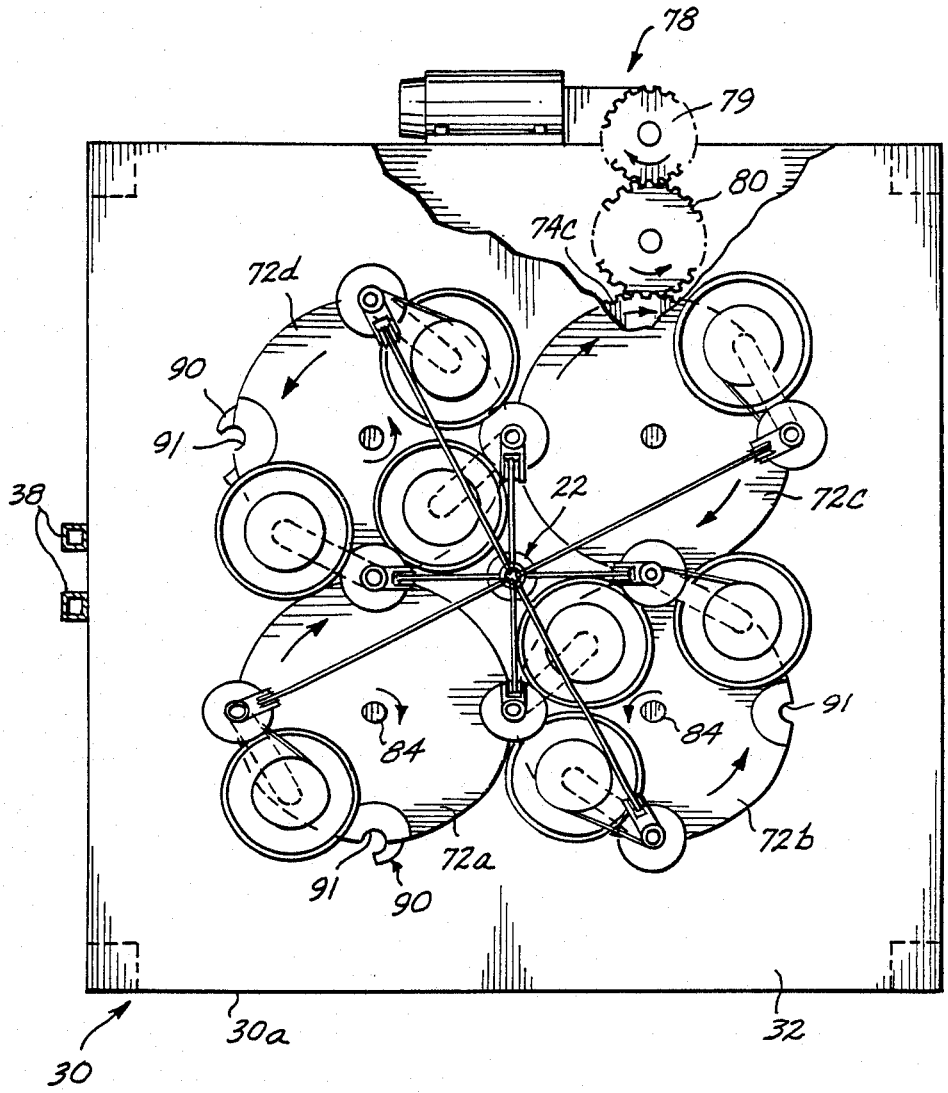
FIG. 2 is a top plan view of the apparatus of FIG. 1, with the friction belt take-off drive assembly omitted for clarity and with a fragment of the support table broken away to illustrate the transport motor drive and drive gear assembly.

With reference to FIGS. 1 and 2, a preferred embodiment of the apparatus 18 for manufacturing braided rope characterized by generally square shaped cross section is shown to include a plurality of strand feed assemblies 20 (see FIG. 2) which are transported in orbits encircling the rope forming axis 22 along which a center core member 24 is continuously advanced lengthwise. A motor driven takeoff assembly 50 frictionally engages the rope after braiding and pulls it along axis 22 away from assemblies 20, causing strands 25 to be drawn under tension into braiding point 26. The combined effect of assemblies 20 orbiting in a particular pattern described more fully below around the lengthwise advancing center core 24 cause the multiple strands from assemblies 20 to be drawn into and braided onto core 24 at a braiding point 26 lying on axis 22.

Figure 21:
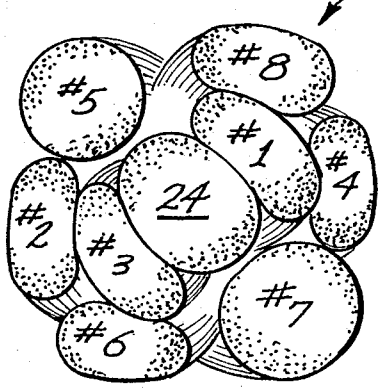
FIG. 21 is an enlarged end view of the rope of FIG. 20 showing a transverse section through the rope to depict the stacking of the individual strands about the rope center core.

In the preferred embodiment eight (8) strands are withdrawn from the orbiting assemblies 20 so that the strands feeding into the braiding point 26 are alternately outside and then inside of braid forming strands from other assemblies 20. As more fully described below, and with reference to FIGS. 2 and 19, the eight separate strand feed assemblies are in this embodiment arranged so as to travel in opposite directions of rotation in first and second crossing orbits of travel centered around the rope formation axis 22 as indicated by the direction arrows shown in FIG. 19. One half of the strand feed assemblies 20 are arranged to travel in a first of the orbits with a rotation clockwise around axis 22 as viewed in FIG. 19, and the other half of the feed assemblies are arranged to travel counter-clockwise in the second orbit. This results in a braiding pattern at braiding point 26 characterized by the creation of corner defining ribs of closely packed, parallel outer strand segments passing in pairs over inner strand segments such that rope 28 exhibits a generally square shaped cross section. The pattern of the square shaped rope braid is best illustrated in FIGS. 20 and 21 and is characterized by each of the corners of rope 28 being formed by a pronounced edge rib comprising closely packed, parallel outer strand segments that extend diagonally to the rope length. Each adjacent pair of such outer strand segments cross over one inner strand segment of opposite diagonal orientation. The inner strand segment emerges midside of the square rope and combines with other like emerging and parallel strand segments to form the adjacent corner of the rope.

Overview of Apparatus 18

Now with more particular reference to FIG. 1, the rope braiding apparatus 18 is constructed on an upstanding support frame 30 including a table **30*a* having a top 32 and a shelf 34 underlying and parallel to top 32 all welded or otherwise rigidly connected to legs 36 and a base plate 38. Support frame 30 also has an overhead support 30*b* that is provided by a vertical riser 38 secured to one side of table 30*a* and supporting near the top thereof an inwardly and upwardly inclined cantilevered support arm 39 for positioning take-off assembly 50 adjacent rope formation axis 22**.

The rope center line or axis 22 is defined by a straight vertical line extending perpendicularly to table 32 and shelf 34 commencing with a center core feed and tensioner assembly 40 mounted on base plate 38 and including guide pulleys 42 and 44 located on opposite ends of a core or strand tensioner 46. Tensioner 46 may be provided by any number of conventional devices, such as an adjustable compression tensioner consisting of a pair of opposing sheaves trapping the center core strand and applying a frictional resistance to its travel through the tensioner. A supply of center core stock, which may itself be a braided or twisted strand of rope, or more generally any of a wide variety of transversely flexible core members including wire, cable, conduit, hose or similar material is withdrawn from a supply reel (not shown) and fed down past guide pulley 42 through tensioner 46 and then turned 90° by guide pulley 44 to define the lower extent of the rope formation axis 22. The upper end of axis 22 is established by the upstream end of a motor driven, friction belt take-off assembly 50, which is described in greater detail in a following section of this description. For now, suffice to say that assembly 50 frictionally grabs the completed rope 28 and applies an upward take-off tension that pulls on the center core 24 and on the braiding strands fed from orbiting assemblies 20, thereby holding the rope formation axis 22 taut between pulley 44 and the upstream pulley and belt end of assembly 50. A guide tube 47 is mounted by upper and lower collar 48 and 49 coaxially with axis 22 to guide center core 24 to the braiding point 26.

With reference to both FIGS. 1 and 2, and especially with reference to the top plan view in FIG. 2, the braiding strands 25 are pulled from the plurality of orbiting assemblies 20 under the take-off force applied to rope 28 downstream of braiding point 26. In this embodiment, each of the eight strand feed assemblies 20 carry with the assembly a bobbin (or spool) 60 of wound supply strand through a series of pulleys, tensioners, and fairleads, which will be described in greater detail in connection with FIGS. 3 and 4. Strands 25 are thereby guided to a feed point adjacent an upper end of a support rod 62 of assembly 20 located at a variable radial distance from axis 22 and axially beneath the vertical height of braid point 26. Thus, the plurality of strands 25 from assemblies 20 feed radially inwardly and upwardly, much like the lines wrapping around a Maypole.

To transport strand feed assemblies 20 in the crossing orbital paths, a transport mechanism 70 is shown in FIG. 2 to include a set of four transport disks **72*a*, 72*b*, 72*c* and 72*d* arranged symmetrically about axis 22 and perpendicular thereto in a common plane of rotation. Diametrically opposed pairs of disks 72*a*, 72*c* and 72*b*, 72*d* are driven by a set of similarly arranged interlocking synchronizing gears, two of which are shown as gears 74*a* and 74*b* in FIG. 1. The synchronizing gears are mounted for rotation in gear shaft bearings 76 affixed to shelf 34 underlying support table top 32. The set of four gears 74*a*, 74*b* (shown in FIG. 1), 74*c* (shown in FIG. 2), and a fourth gear not visible in the drawings but underlying disk 72*d* of FIG. 2** are mounted for coplanar rotation with the peripheral teeth of each gear engaging the pair of peripherally adjacent gears so that each set of diametrically opposed gears rotate in the same directional sense, i.e., either clockwise or counter-clockwise.

A motor drive assembly 78 is mounted on one side of table **30*a* and includes a drive gear 79 that operates through an idler gear 80 to drive gear 72*c* of the set of four gears in a clockwise direction as viewed from the top of table 32. The gear shafts 84 for each of gears 74 are extended through couplers 82 to drive corresponding disk shafts 86 passing through disk bearings 88. A coupler 82, shaft 86 and bearing 88 is provided for each of the four disks 72*a*–72*d*. Diametrically opposed disks 72*a* and 72*c* rotate clockwise to rope axis 22, and the other pair of diametrically opposed disks 72*b* and 72*d*** rotate counter-clockwise.

Figure 19:
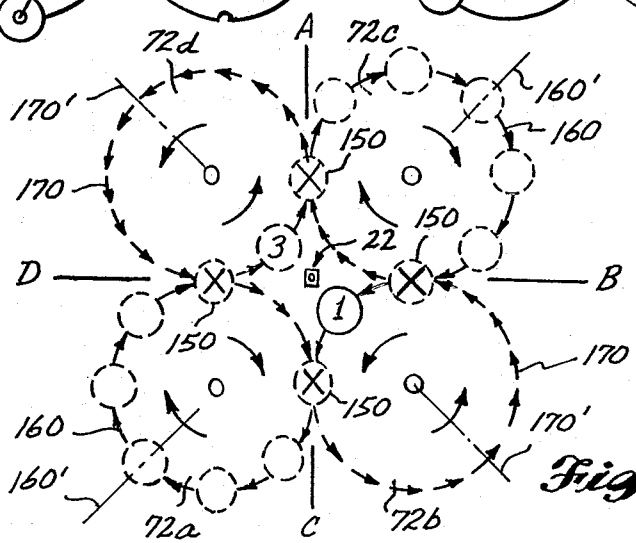
Figure 20:
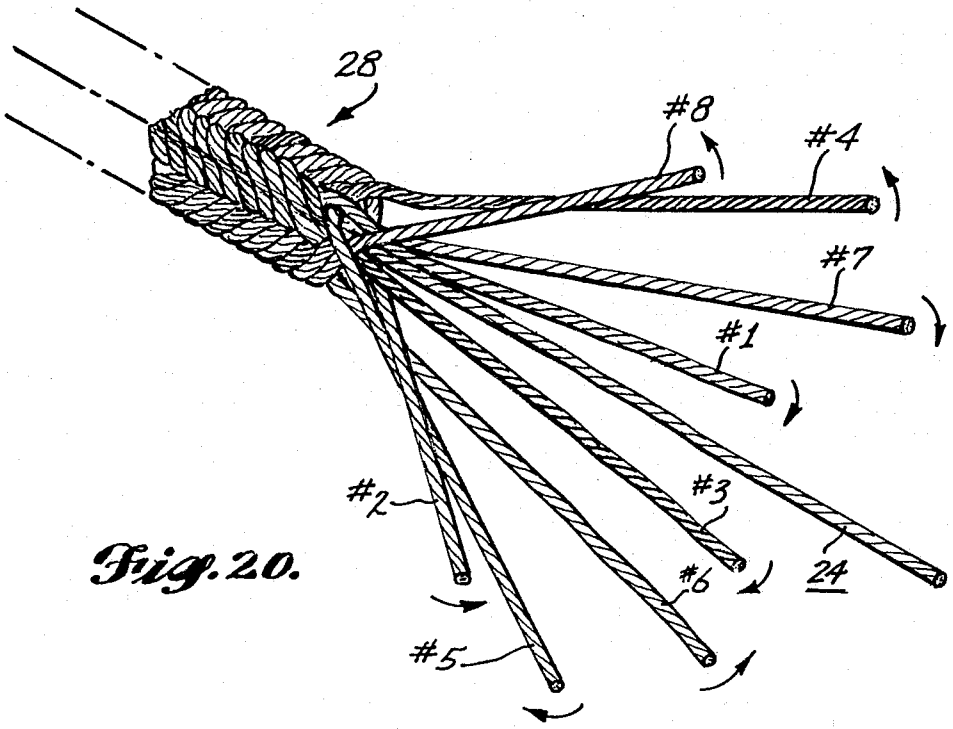
FIG. 20 is an enlarged, isometric view of the braided rope with one end partially unraveled to depict the braiding pattern.

As described more fully in connection with FIGS. 5–8, a plurality of cam operated latches 90 (see FIG. 2) are mounted at circumferentially spaced intervals around the perimeter of each disk to cyclically clamp and release the support rods 62 of each of assemblies 20 so as to transport assemblies 20 from disk to disk to effect the crossing orbits shown in FIG. 19. The latches 90 are operated by internal cam mechanisms residing within annular hollow spaces of disks **72*a*–72*d*. Assemblies 20 are thus released from the perimeter of one disk and transferred to the perimeter of an adjacent, counter-rotating disk by coordinated operation of the latches 90 as a function of disk rotation. One half of the assemblies 20 travel around the clockwise orbital pattern defined by a combination of the outer perimeters of rotating disk pairs 72*a* and 72*c*, and inner perimeters of the oppositely rotating disks 72*b* and 72*d*. Similarly, the remaining set of four assemblies 20 travel in a counter-clockwise orbit around the outer perimeters of disks 72*b* and 72*d* with mid-orbit travel along the interior perimeters of disks 72*a* and 72*c*. The result of this transport pattern of assemblies 20 will be described in further detail below in connection with sequential diagrams in FIGS. 9–18**.

Strand Feed Assembly

Figure 4:
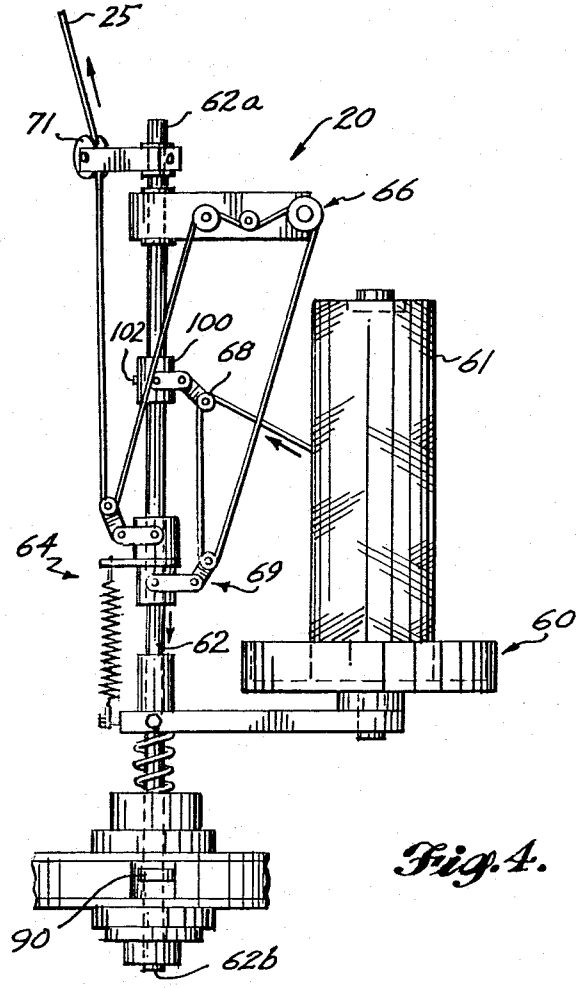
FIG. 4 is also a side elevation view of the strand feed assembly, depicting the components of the assembly in changed operating state when the tension in the fed strand is relaxed.
Figure 3:
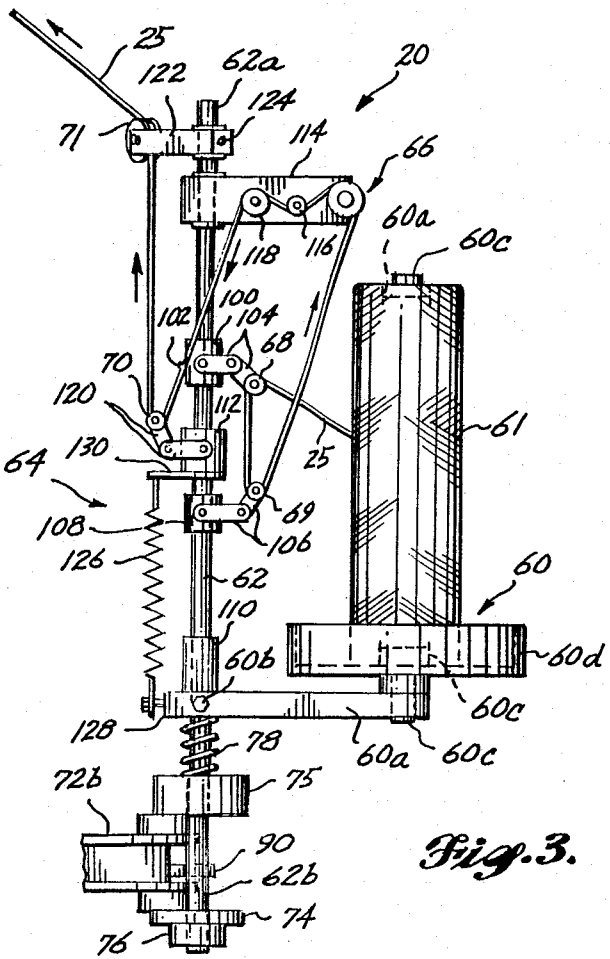
FIG. 3 is a side elevation view of one of the strand feed assemblies shown in a configuration for exerting maximum strand tension and illustrating the spool (or bobbin) holder, strand supply spool (or bobbin), strand guide, tensioning and strand advance sub-assemblies.

With reference to FIGS. 3 and 4, each of strand feed assemblies 20 include the above mentioned support rod 62, a bobbin (or spool) holder 60 on which a bobbin 60*a* of prewound stock strand 25 is carried, a reciprocating recoil spring sub-assembly 64, a compression tensioner 66, a plurality of fairleads 68, 69 and 70, and a guide pulley 71. Rod 62 is releasably clamped adjacent its lower end 62*b* to semicircular detents in upper and lower peripheral edges of one of disks 72 by a latch 90 such that the axis of rod 62 extends normal relative to the coplanar disks in this embodiment, and parallel and radially outwardly spaced from the rope formation axis 22. Self-lubricating, axially spaced annular bushings 74 and 75 are secured between a retaining nut 76 on the lower end of rod 62*b* and a compression spring 78 to locate rod end 62*b* relative to the transport disk and clamping latch 90 and to eliminate play between the rod and disk detents. The entire rod 62 is thereby held in a substantially rigid condition with respect to the transport disks in order to sustain substantial bending load applied near the upper end 62*a* of the rod by the braiding tension in strand 25. The tension in strand 25 increases to a maximum during the travel of assembly 20 around the outer most perimeter of each of the transport disks (see FIG. 19). In this condition, the strand tension tends to pull the upper end of rod 62*a* inwardly toward the rope formation axis. The clamping of the lower end of rod 62*b* is designed to enable the support rod to remain substantially rigid and to resist the significant bending of rod 62.

Bobbin holder 60 includes a transversely extending support arm 60*a* secured by a pin 60*b* through rod 62 just above bushing 75 such that arm 60*a* extends transversely outwardly from this position. The outboard end of arm 60*a* has a bobbin spindle 60*c* fixed with upper and lower bearings 60*d* and 60*e* that nest inside a cardboard tube on which the supply strand is wound. A bobbin cup 60*d* is also attached to arm 60*a*. Bobbin 61 is free to rotate relative to spindle 60*c* such that stock strand 25 is unwound from the bobbin as needed. Cup 60*d* serves to catch any loose strand material that is unwound from the bobbin but is not immediately pulled into the fairleads 68 and 69.

From bobbin 61, strand 25 is passed through a first fairlead 68 mounted at a fixed, mid-height position on rod 62 by collar 100 held in place by a set screw 102 (best seen in FIG. 4) and links 104 holding fairlead 68 somewhat outwardly from collar 100 and rod 62. Strand 25 passes downwardly from fair lead 68 through another fairlead 69 mounted by links 106 to a slider 108 that is free to move up and down on rod 62 between a spacer 110 and a reciprocating recoil slider 112 that is part of a recoil spring sub-assembly 64. From fairlead 69, strand 25 passes upwardly to compression tensioner 66 mounted on a fixed arm 114 along with idler guide 116 and fairlead 118. Arm 114 is secured by a set screw to a fixed height position on rod 62 near upper end 62*a*. From tensioner 66, idler guide 116 and fairlead 118, strand 25 passes downwardly again through a recoil fairlead mounted by links 120 on recoil slider 112 and then turns upwardly, passing around guide pulley 71 and thence toward the braiding point 26 (see FIG. 1). Guide pulley 71 is mounted for rotation at the end of an arm 122 which is itself held to the upper end 62*a* of rod 62 by a set screw 124.

Assembly 64 includes a recoil tension spring 126 that is arranged parallel to the rod axis and is fastened at the lower end to a stub 128 on arm 60*a* and at the upper end to a flange 130 projecting radially from the lower end of recoil slider 112. Recoil slider 112 and spool advance slider 108 reciprocate on rod 62 between stops formed by fixed collar 100 and spacer 110 to accommodate the variable tension in strand 25 as the strand feed assemblies move radially inwardly and outwardly on the transport disks relative to the rope formation axis to withdraw strand from bobbin 61 on demand as the strand 25 is pulled toward the braiding point. FIG. 3 shows the configuration of assembly 20 when the tension in strand 25 is at a maximum, corresponding to the outer peripheral travel of the assembly on one of the four transport disks. In this mode, the tension on strand 25 increases to a maximum, pulling upwardly on fairlead 70, extending spring 126 to maximum spring force until the tension in tensioner 66 is overcome and strand 25 is allowed to advance. This extension of spring 126 causes recoil slider 112 to move to its upper travel extent which in turn allows spool advance slider 108 to likewise move up on rod 62 as strand 25 is pulled through tensioner 66 forcing fairlead 69 upwardly.

After the assembly 20 passes around the outermost extent of the orbit (see FIG. 19) and begins to travel back toward the rope formation axis, the tension in strand 25 tends to relax, allowing spring 126 to recoil, pulling recoil slider 112 downwardly on rod 62. The lower end of recoil slider 112 thereby forces the spool advance slider as shown in FIG. 4 downwardly on rod 62. The resistance created by tensioner 66 is greater than the force required to dereel strand from bobbin 61 and thus the downward movement of spool advance slider 108 as shown in FIG. 4 dereels additional strand 25 from bobbin 61. By advancing the strand in this manner a more uniform braiding tension is achieved, not affected by the dereeling force.

During the operation of assemblies 20 to feed strands 25 to braiding point 26 as shown in FIG. 1, assemblies 20 are free to rotate as a unit on the axis defined by rod 62 so that guide pulley 71 is always facing radially inwardly toward the rope formation axis 22. For this purpose, the entire rod 62 and components mounted thereon rotate in the grasp of latches 90 and the disk detents. As illustrated in FIG. 2, the rotation of assemblies 20 occurs in concert with all of the other assemblies such that the bobbin holders 60 contact one another and rotate with rod 62 to a free space as the entire plurality of assemblies travel in the crossing orbits shown in FIG. 19.

Disk and Latch Transport Mechanism

Figure 6:
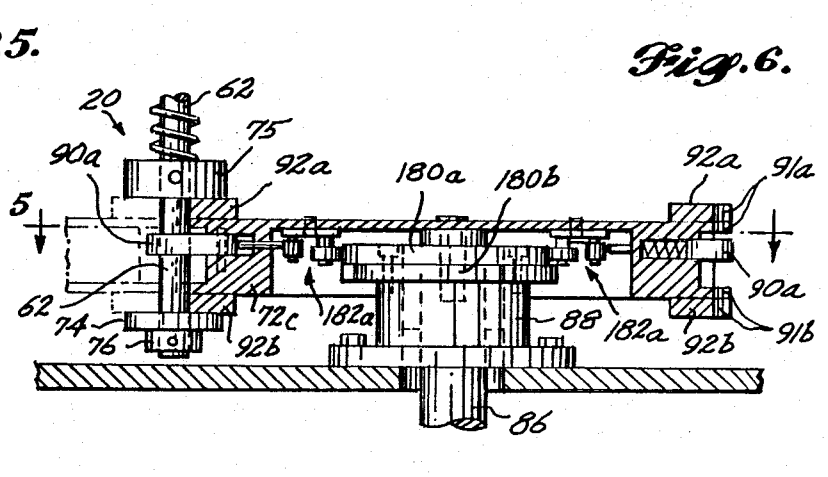
FIG. 6 is a sectional view taken along a vertical, offset cutting plane indicated by section line 6—6 in FIG. 5.
Figure 5:
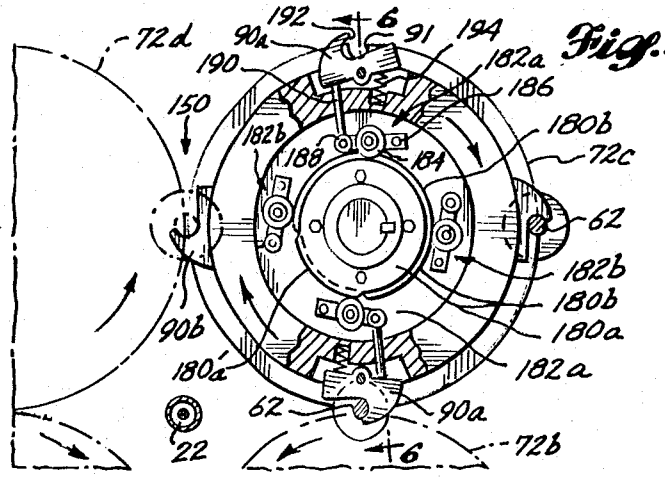
FIG. 5 is a fragmentary view of one of the four synchronously rotating disk assemblies that together transport the strand feed assemblies in orbital paths around the rope formation axis, in which an upper plate of the disk has been removed to view the interior cam operated latch sub-assemblies that enable the disk to transfer the strand feed assemblies from one disk perimeter to another during the orbital travel.
Figure 7:
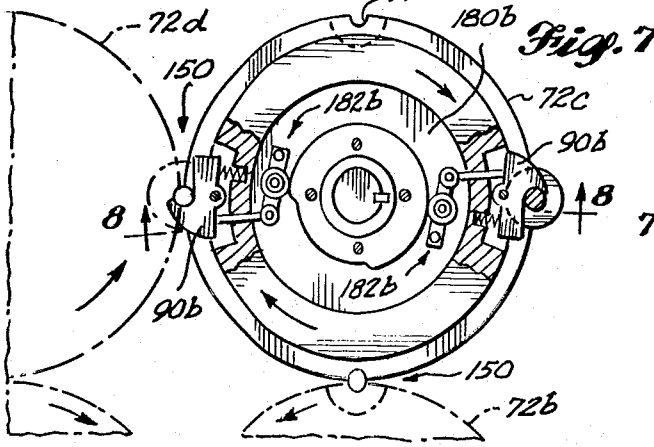
FIG. 7 is a fragmentary, top plan view similar to FIG. 5 but broken away so as to show more clearly another set of cam operated latch sub-assemblies included within the transport disk assembly.

The cam operated latches 90 mounted on the set of four synchronously rotating transport disks 72*a*–72*d* are shown in greater detail in FIGS. 5–8 to include circumferentially alternating (at 90° intervals) upper latches 90*a* and lower latches 90*b*. The upper and lower latches 90*a* and 90*b* on each disk are so placed relative to corresponding upper and lower latch assemblies on the immediately adjacent disks to enable the strand feed assemblies, and namely rod 62 of such assemblies, to be exchanged or transferred between disks at transfer or exchange positions 150 as indicated in FIGS. 5 and 7. At these exchange positions 150, an upper latch 90*a* and a lower latch 90*b* on respective adjacent disks 72 are both simultaneously in contact with the assembly support rod 62: one of the latches releasing the rod 62 from its clamping hold and the other latch on the adjacent disk grabbing and clamping rod 62 to the peripheral detents 91 of the associated disk.

Thus in reference to FIG. 5, viewing the assembly of disk 72 as a clock, at the 12 o'clock position an upper latch 90*a* is provided followed at the 3 o'clock position by a lower latch 90*b*, then another upper latch 90*a* at the 6 o'clock position and finally a lower latch 90*b* at the 9 o'clock position. At the exchange points 150 in FIG. 5, the lower latch 90*b* of disk 72*c* cooperates with an upper latch (not shown) on the adjacent dotted line disk 72*d*, and the upper latch 90*a* at the 6 o'clock position on disk 72*c* cooperates with a lower latch (again not shown) on the adjacent disk 72*b*. With reference briefly to FIG. 19, the exchange points 150 occur at the four crossing or intercept points of the first and second counter-rotating travel orbits 160 and 170.

To effect this exchange from disk to disk, an internal camming assembly is provided within an interior hollow annular area of each disk (see in FIGS. 6 and 8), including axially aligned upper and lower fixed cams 180*a* and 180*b* and cooperating upper and lower follower and rocker assemblies 182*a* and 182*b*, including a push rod actuator for each latch as indicated in FIG. 5. Each such follower and rocker assembly 182*a* and 182*b* includes a follower bearing 184 mounted on a rocker arm 186 for being articulated radially inwardly and outwardly in response to cam 180*a* to cause a push rod actuator 188 to force push rod 190 outwardly against latch 90*a* offset from a latch pivot to close a catch portion 192 of latch 90*a*, clamping the rod against disk detents 91. A return spring 194 held in a recess and acting against the opposite end of pivoted latch 90*a* biases the latch to an open position to which the latch returns when cam follower 186 is displaced radially inwardly against the recessed track on cam 180*a*. A corresponding operation is provided by the lower cam follower and rocker assemblies 182*b* reacting to the lower fixed cam 180*b*.

Figure 8:
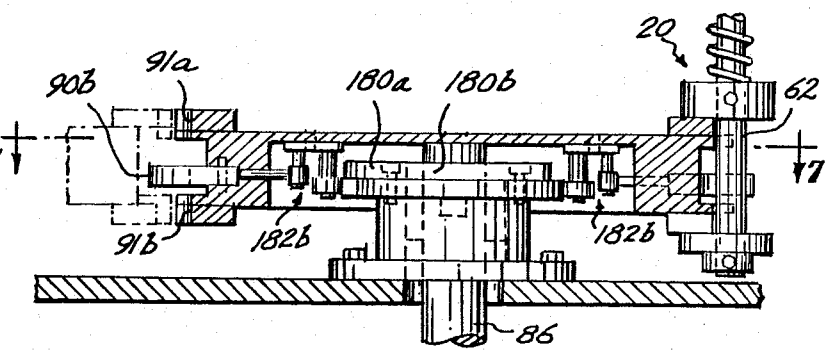
FIG. 8 is a sectional view taken along a vertical cutting plane through the disk assembly of FIG. 7 in which the cutting plane is offset from the diameter as indicated by section line 8—8.

The upper and lower cams 180*a* and 180*b* are themselves stationary and are affixed to the outer circumference of bearing 88 (see FIGS. 6 and 8). The disk itself, in this case disk 72*c* has a central hub or boss 198 journaled for rotation within an interior cylindrical journal of bearing 88 and is driven by the upwardly extending shaft 86 from coupler 82, with shaft 86 being keyed (key not shown) to boss 198. Each disk, such as disk 72*c* in this instance, is essentially drum shaped with a hollow annular interior region separating boss 198 from an outer circumferential portion of substantial axial thickness to form at the upper and lower peripheral edges of disk 72*c* along with upper and lower wear plates 92*a* and 92*b*, the pair of upper and lower aligned detents 91*a* and 91*b*, between which either an upper or lower latch 90*a* or 90*b* is mounted. Thus in FIG. 6, the upper latches 90*a* are shown to be located near the top of the axially thickened outer perimeter of disk 72*c*, and in FIG. 8 the lower latches 90*d* are shown to be mounted near the lower portion of the axially thickened disk between detents 91*a* and 91*b*. In each case, the follower and rocker assemblies 182*a* and 182*b* are mounted to the underside of disk 72*c* within the hollow annular region between fixed cams 80*a* and 180*b* and the latches 90*a* and 90*b*.

The cams 180*a* and 180*b* are radially dimensioned relative to circumferential travel of follower assemblies 182*a* and 182*b* so that the upper latch operating cam 180*a* has a relatively small sector lobe 180*a*' and faces inwardly toward the rope forming axis 22. This shape and orientation causes the upper follower and rocker arm assemblies 182*a* to close their respective latches 90*a* as such latches travel through the relatively short inner perimeter travel path adjacent axis 22. Conversely, the lower latch cam 180*b* has a radially outwardly projecting lobe that extends through a major circumferential sector of disk rotation, substantially complementing the lobe 180*a*' as best shown in FIG. 5. Thus the lobe 180*b*' of the lower cam 180*b* causes the corresponding lower latch follower assemblies 182*b* to operate to close their respective latches 90*b* as these latches pass from the exchange points 150 outwardly away from axis 22 in the radially outermost travel of orbits 160 and 170 as depicted in FIG. 19. By using the lower latches 90*b* to grab and clamp the support rod 62 of the strand feed assemblies during the outmost travel sector, greater load resisting strength is achieved in holding rod 62 to the detents 91*a* and 91*b* when the inward pull by strand 25 on the upper end 62 of the support rod is at maximum.

The sector of the upper cam lobe is about 90° and extends circumferentially between exchange points 150; the sector on the lower cam is about 270° and faces outwardly away from the center of the assembly and extends around the outer travel path from one exchange point 150 to the next point 150. The upper and lower cams are mutually contoured at the exchange point so that the cams cooperatively open and close smoothly on the assembly support rod 62 during the transfer without binding. At the exchange point, the semicircular detents on the adjacent disks rotate into a position in which they are in opposing registration so that the support rod 62 is held captive between the disk detents.

Take-Off Assembly

Friction belt take-off assembly 50 is mounted on the inwardly and upwardly cantilevered support arm 39 of support frame 30 as shown in FIG. 1 and includes a variable speed motor 200 having a direct drive connection to a drive pulley 202 which, along with a driven pulley 204, cooperates with a belt 206 having an outer friction surface 208 against which the braided rope 28 lies in frictional contact. Motor 200 is mounted by a bracket 210 to arm 39 and an output drive assembly provides a journaled shaft on which the driven pulley 202 is mounted. Thus pulley 202 rotates on an axis transverse to and spaced outwardly from the rope axis 22. Support arm 39 and support riser 38 are formed by pairs of identical structural members spaced apart so that the ends of arms 39 receive there between the journaled pulley 204 positioning the exterior friction surface 208 of the belt 206 tangentially to the rope formation axis 22. A spring biased hold-down roller assembly 212 is mounted by a bracket 214 to arms 39 such that a roller 216 is spring biased toward pulley 204 and belt 206 holding rope 28 against belt surface 208. Rope 28 turns around pulley 204 and belt 206 staying in frictional contact with the belt surface 208 along its upper travel. Another spring biased hold-down roller assembly 218 forces a hold-down roller 220 to press rope 28 against the friction belt at pulley 202. Hold-down roller assembly 218 is mounted to arms 39. The hold-down spring bias is adjustable on assembly 212 as indicated at 217 and a similar adjustment is provided for assembly 218 as indicated at 222. The upper surface 208 of belt 206 is inclined downwardly and forwardly such that as the completed rope 28 passes between pulley 202 and hold-down roller 220, it falls by its own weight into a coiling bucket 226.

The take-off assembly 50 is operated at an adjustable speed by controlling the speed of motor 200 (by conventional controls not shown) so that in conjunction with the friction holding force of belt 206 and hold down rollers 216 and 220, an optimum axially directed tension or take-off force is applied to rope 28 along axis 22 at a position on the downstream side of the braiding point 26 from the strand feed assemblies. This take-off tension applied at braiding point 26 is counter-balanced by the combined vertical tension force components in the plurality of strands 25 and in the center core 24.

In this embodiment separate speed controls are used for the transport motor 78 and the take-off motor 200. Alternatively, a common speed control may be used with a fixed or adjustable speed ratio determining the relative speeds of these assemblies.

Operation

As mentioned above, apparatus 18 operates to transport a plurality of strand feed assemblies 20 in two orbits encircling the rope formation axis that are oriented so as to cross one another at four intersecting locations 150 as illustrated in FIG. 19. More particularly, the two intersection orbits 160 and 170 define in this embodiment, orbit axes 160' and 170' that are arranged orthogonally so that each orbit 160 and 170 passes outside the other orbit in diametrically opposed sectors, such as sector A-B diametrically opposing D-C for orbit 160 in FIG. 19. Similarly, the counter-rotating orbit 170 defines diametrically opposing sectors B-C and A-D. The orbits in this embodiment are essentially elongated along the axes 160' and 170' and are pinched inwardly mid-orbit where the strand feed assemblies pass around the interior perimeter of the co-rotating disks *72a–72d*.

Figures 9, 10, 11, 12, 13, 14:
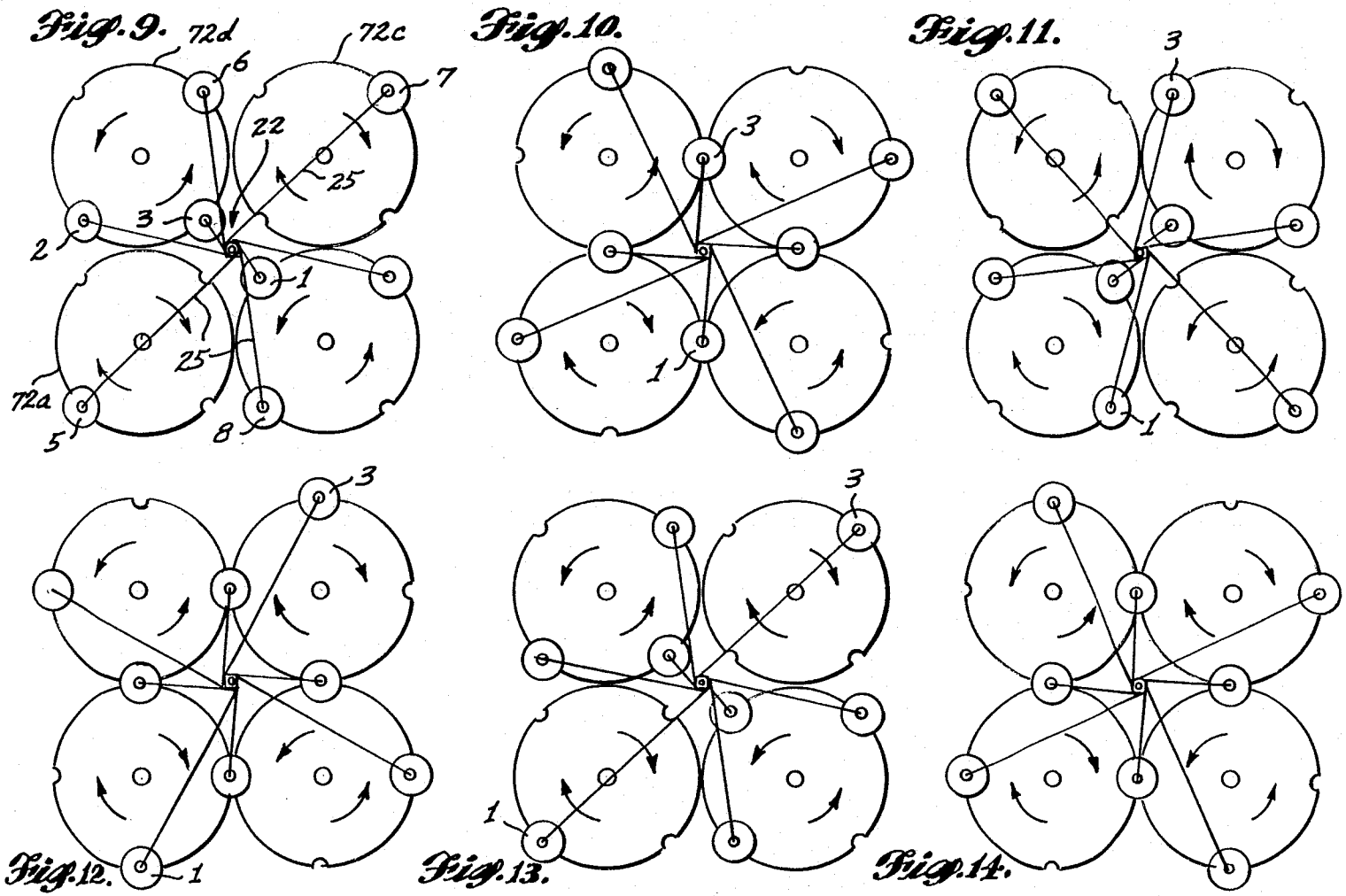
FIGS. 9–18 represent a series of schematic diagrams of the sequence of relative disk rotation (45° increments) and corresponding travel of a plurality of eight strand feed assemblies in orbits around the rope formation axis during the operation of the apparatus depicted in FIGS. 1 and 2.

To describe the sequence of transport disk rotation and orbital travel of the plurality of eight strand feed assemblies 20, these assemblies and associated strands are labeled #1–#8, as illustrated in FIGS. 9–18. The starting position of the assemblies (20) #1–#8 is shown in FIG. 9 where the #1 and #3 assemblies are at a midpoint of their inner travel path, proximate to rope formation axis 22; assemblies #2 and #4 are in the outer travel paths but are being rotated inwardly toward the rope axis; assemblies #5 and #7 are at the midpoints of the outermost travel path where the tension on strands 25 is maximum; and the final pair of assemblies, #6 and #8 are commencing the outer perimeter travel associated with increasing strand tension.

It is observed that a set of assemblies corresponding to one half of the total, which must be an even number, traverse one of the orbits while the other half of the even numbered assemblies traverse the other crossing orbit. Thus in FIG. 9, the strand feed assemblies that travel in the clockwise orbit 160 (see FIG. 19) are given odd numbers, namely #1, 3, 5 and 7, while the remaining set of assemblies traveling in the counter-clockwise orbit 170 (see FIG. 19) are given even numbers, namely #2, 4, 6 and 8. These same even and odd numbered assemblies remain in the indicated respective orbits 160 and 170 such that as any two pairs of strand feed assemblies, such as #4 and 8, and #2 and 6 travel about the diametrically opposing outer perimeter sectors, there are two assemblies, such as in this case assemblies #1 and 3, traveling in opposite directions around the rope axis which are passing inside (toward axis 22) of the outer orbiting assemblies. Hence during a given braiding sequence, outer assemblies #4 and 8 cause their corresponding strands to cross over the counter-rotating assembly #1 and in the same sequence the outer travel of assemblies #2 and 6 cross over the inner and counter-rotating assembly #3. This braiding sequence causes the diagonally opposed corners of the resulting rope to be formed simultaneously by pairs of adjacent outer strands wrapping diagonally over one inner crossing strand going in the opposite diagonal direction.

Figure 17:
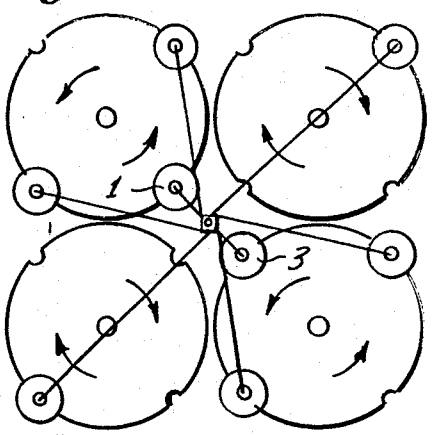
Figure 16:
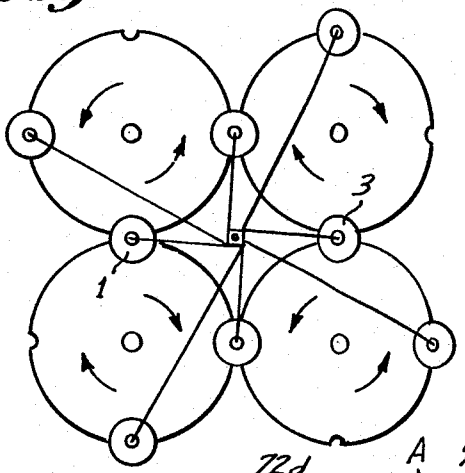
Figure 15:
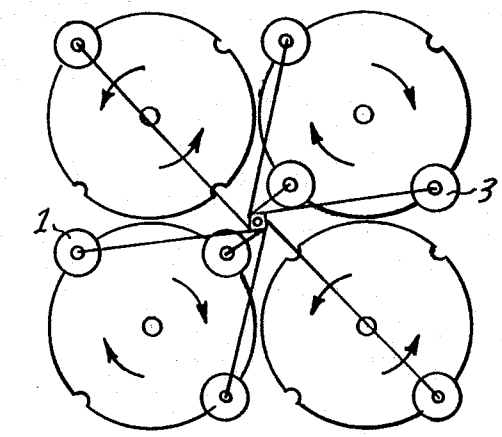
Figure 18:
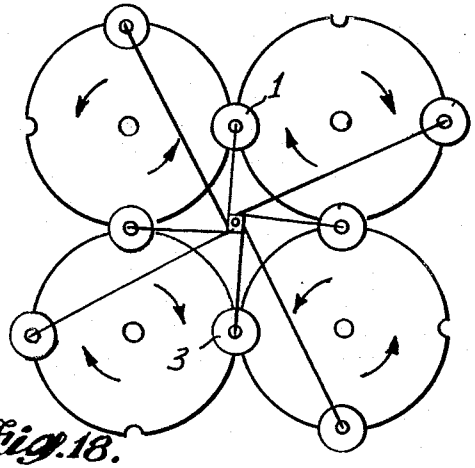

Each of the succession of FIGS. 10–18 show the advancement of the transport mechanism through a 45° rotation. Thus in FIG. 10, assembly #1 has been transported along an inner travel path to an exchange point with an adjacent disk and is about to commence the travel around the outermost perimeter of the adjacent disk. Thus in FIG. 11 the assembly #1 has been transferred to the adjacent disk and is moving away from the rope axis 22, causing increasing strand tension balanced by an opposing strand tension in assembly #3 traversing the diametrically opposite outer sector. Passing through another 45° travel increment shown in FIG. 12, the assemblies #1 and 3 reach the condition shown in FIG. 13 where they are at the outermost radial paths where the maximum strand tension is developed. Likewise, FIGS. 14–15 show the progression of assemblies #1 and 3 back to an exchange position where assemblies #1 and 3 are transferred again to the other set of rotating disks to travel the radially inner most travel path. FIG. 17 corresponds to the position of the assemblies shown in FIG. 9 except the assemblies are in the reverse image orientation. Finally, in FIG. 18, the strand feed assemblies are advanced to a condition in which assembly #1 is about to be transferred to the outer perimeter path of disk *72c* and assembly #3 is to be transferred to the outer perimeter travel path of disk *72a*. As the pattern has been established by the sequence of FIGS. 9–18, further position diagrams beyond FIG. 18 are redundant. The positions of assemblies #1 and 3 shown in FIG. 19 correspond to the starting positions of FIG. 9.

Characteristics of Resulting Rope Product

FIG. 20 illustrates the braiding pattern of the resulting rope 28 by showing the unraveling of strands 25 from the central core 24. By numbering the strands #1–8 to correspond to the notation shown in FIGS. 9–18, it will observed that each corner of the rope 28 is formed by closely packed, parallel and exterior strand segments such as strands #4 and 8 diagonally oriented to the rope axis and crossing in pairs over an interior strand segment such as segment #1 oriented in the opposite diagonal direction. This sequence of two successive passes of outer strand segments such as #4 and 8 over an inner strand segment #1 corresponds to the sequence of the transport mechanism shown roughly by the condition of FIG. 9, discussed above. Thus, in FIG. 9, the strand from the #1 assembly has bee crossed by the #4 assembly strand and is about to be crossed by the #8 assembly strand as disk *72b* rotates in a counter-clockwise sense. At the same time that the near side corner of rope 28 shown in FIG. 20 is formed by the FIG. 9 sequence, a diagonally opposite corner of the rope is being simultaneously formed by strands from assemblies #2 and 6 crossing over the strand from the counter traveling assembly #3.

While the square rope 28 manufactured by the apparatus described above is formed of transversely flexible filaments of bundled, twisted or prebraided strands, such as made from olefin fiber (available under the trademark HERCULON, a registered trademark of Hercules Inc.), it will be appreciated that the constituent strands 25 and center core 24 may be selected from a wide variety of material. For example, wire may be braided onto a center core of wire or fiber material, and fiber material may be braided as strands 25 onto a wire center core 24. The center core, while being a transversely flexible strandlike material in the above described embodiment, need not be a transversely flexible rope or wirelike material. For example, center core 24 may be a rigid, elongated rod or like member with the take-off mechanism re-oriented so as to allow for a continuous take-off in the direction of axis 22 (see FIG. 1).

In another application of the disclosed apparatus and process, strands 25 may be braided onto a stationary, rigid elongate center, such as provided by an upstanding needle mounted along axis 22 at braiding point 26 in FIG. 1. In such case, during the braiding process, the outer braided strands are withdrawn from the stationary center needle to produce a hollow, sheathlike rope product. Such a sheathlike product might, for example, be used as a covering or a gripping sheath that is slid over guy wires or like objects to facilitate hand grip. An alternate technique is to form the rope sheath by braiding the strands onto hollow tubing that is advanced along the axis 22 in place of center core 24 with the resulting product having a hollow center for slipping over another elongate member.

In another application of the apparatus and method, the strands 25 may be braided onto a transversely flexible conduit, duct, or hose to provide a protective and pressure sustaining covering or a grippable sheath when the product is to be manipulated or hauled by hand. These are but a few examples of the broad range of applications of the braiding apparatus and method described above.

Alternative Embodiment of Strand Feed Transport Mechanism

In FIGS. 22–25, an alternative transport mechanism 70' is used in place of the above described transport 70 of the embodiment of FIGS. 1–8. As many of the components of the alternative transport 70' correspond to those described above, corresponding reference numbers with a prime (') notation are used to indicate like or similar parts. Thus for transport 70', the mechanism is mounted on a support frame including a table 30a' to which riser 38' is affixed to one side (see FIGS. 22 and 23). A plurality of strand in counter-rotating, crossing orbits 160' and 170'. In this embodiment, orbits 160' and 170' are of generally oval shape and are defined by slotted tracks 160a' and 170a' formed through an upper support plate 250 mounted by standoffs 252 above a table top 32'. Standoffs 252 space plate 250 sufficiently above table top 32' so as to accommodate an assembly of the synchronously rotating, symmetrically arranged coplanar drive disks 72a', 72b', 72c' and 72d', and a corresponding underlying set of inter-engaging drive gears 74a', 74b', 74c' and a fourth gear not visible but underlying disk 72d'. These gears and their associated transport disks are mounted for joint rotation on a plurality of shafts 254 journaled for rotation in bearings 256, the latter being mounted to the underside of table 32'.

Figure 22:
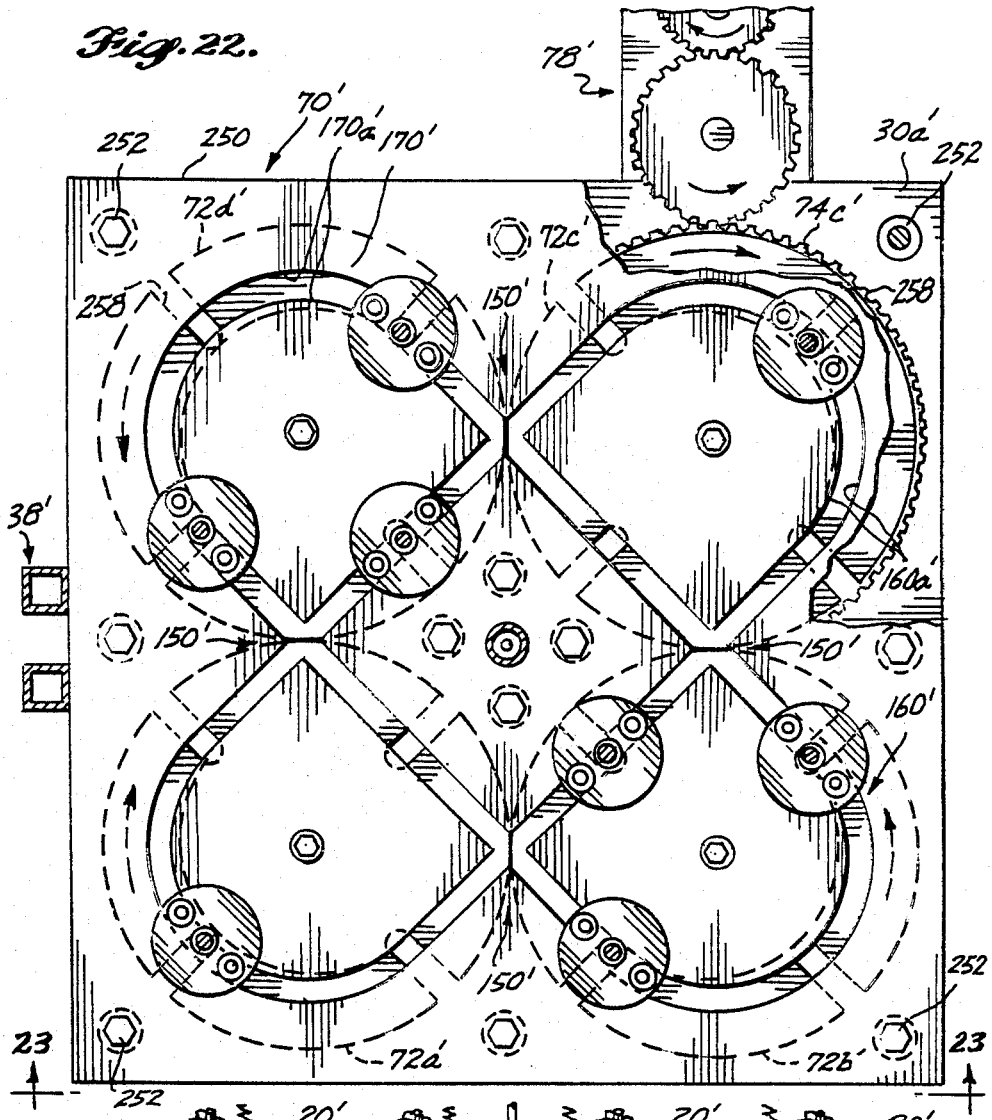
FIG. 22 is a top plan view of an alternative embodiment of the invention in which the transport for the strand feed assemblies is formed by a platform having crossing oval tracks provided therein to constrain the travel orbits of the strand assemblies which are driven by coplanar, synchronously rotating disks having assembly drive slots formed in the perimeters.
Figure 23:
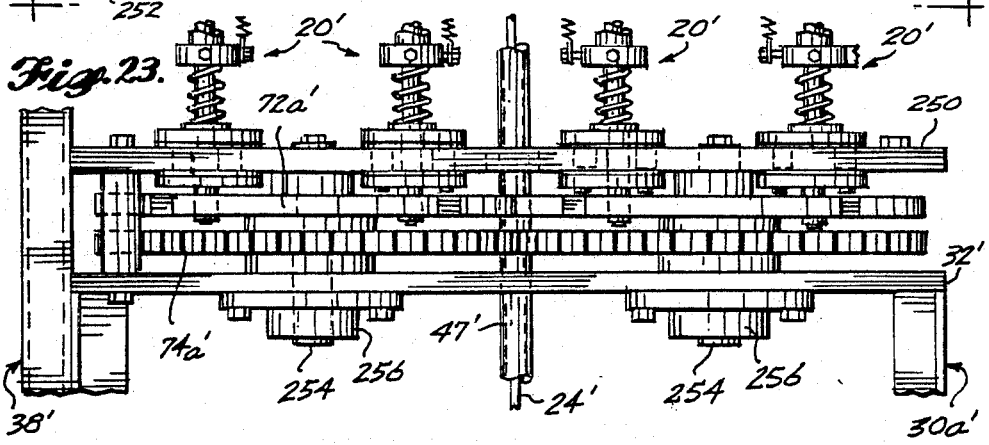
FIG. 23 is a side elevation view of the transport mechanism of FIG. 22.

Each of the transport disks 72a'–72d' is formed with radially inwardly extending slots 258 (see FIG. 24) positioned at 90° intervals about the center of the disk for receiving and driving a downwardly extending end 62b' of each of the strand feed assemblies 20'. This arrangement is best shown in FIGS. 24 and 25 in which each of assemblies 20' is provided adjacent the lower end 62b' with a drive base assembly including a pair of upper and lower, axially spaced disks 260a and 260b arranged to be in sliding contact with the upper and lower faces of track plate 250. Disks 260a and 260b are coaxially arranged on rod 62' and the lower end 62b' of the rod is equipped with a sleeve roller 262 that extends downwardly through the slotted tracks 160a' and 170a' so as to be received within one of the disk drive slots 258 as best depicted to FIG. 25. A pair of eccentrically disposed guide rollers 264 and 266 and associated roller guide pins 268 and 270 are mounted on disks 260a and 260b with rollers 264 and 266 arranged in a line with roller 262 and rod 62'. The arrangement of rollers 262, 264 and 266 in a line as shown in FIG. 24 maintain the associated assembly 20' in the established travel direction as such assemblies pass through the cross over points 150' of tracks 170a' and 160a' as best depicted in FIG. 22. To prevent these aligned rollers 262, 264 and 266 from binding as the assembly negotiates around the curvature at the end of each oval track, the underside of plate 250 adjacent the radially inward portion of each end of the oval tracks is undercut as depicted by dotted line 272 in FIG. 24 in order to allow the eccentric rollers 264 and 266 to negotiate the turn without binding in tracks 260' and 270a'.

At each exchange point 150' as shown in FIG. 22, the driven roller 262 at the lower rod end 62b' is transferred from a slot on one disk perimeter to an opposing, registering slot on an adjacent disk and the driven roller 262 guided by the eccentric rollers 264 and 266 continues the established line of travel through the crossing tracks.

With comparison to the hour glass shaped orbits of FIG. 19 for the previously described embodiment, it will be appreciated that the crossing oval tracks 160' and 170' of the embodiment of FIGS. 22–25 produce the same braiding pattern, with the only difference being in the shape of the inner travel paths of the transported strand assemblies.

In the foregoing embodiments, apparatus and method have been disclosed in which the braid is formed from a plurality of eight supply strands. Accordingly, eight orbiting strand supply assemblies 20 and 20' have been provided. The same essential braiding pattern and resulting rope product is produced by other variations of the apparatus and method disclosed above. For example, rather than feeding just a single strand 25 from each assembly 20 and 20', two or more spools or bobbins, like bobbin 61, may be mounted on an orbiting assembly and fed through similar guides and tensioners into the braiding point 26 as the assemblies orbit and braid as described above. The resulting rope would have a braid formed from a plurality of a multiple of eight strands such as 16 for two bobbins on an assembly, or 24 in the case of three bobbins per assembly; however, the braiding pattern itself would remain the same. Each single strand as shown in FIG. 20 would be replaced by 2, 3 or more separate strands but exhibiting as a composite or bundle of such strands the same braiding pattern and same generally square cross section as depicted in FIG. 20. Furthermore, an alternative method and apparatus is contemplated in which instead of eight strand feed assemblies 20 or 20' mounted on the transport, a plurality of sixteen separate such assemblies would be arranged with a set of eight assemblies orbiting in each of the counter rotating orbits. The construction and operation of such an apparatus with sixteen separate strand feed assemblies would use the same principles of design as disclosed above, and will produce a rope product having a similar braiding pattern to that alternative described above in which two bobbins are arranged on each of eight strand feed assemblies. Thus, in general, the principles of the invention are equally applicable to method and apparatus using a multiple of eight source strands fed into the braiding point.

While only particular embodiments have been disclosed herein, it will be readily apparent to persons skilled in this art that numerous changes and modifications can be made to these embodiments including the use of equivalent means, devices and method steps, without departing from the spirit of the invention.

I claim:

1. An apparatus for braiding rope having a generally square shaped cross section comprising:

a support;

center core feed means mounted on said support and adapted for feeding an elongate core member lengthwise relative to said support along a rope axis passing through a braiding point;

a plurality of strand feed assemblies arranged around said rope axis adjacent said braiding point and each assembly adapted to carry a supply of strand that is to be braided with strands from the other said assemblies on to said core member;

transport means mounted on said support for transporting a first set of said assemblies in a first set orbit around said rope axis in one direction, and for transporting a second set of said assemblies in a second set orbit around said rope axis in an opposite direction, said first set orbit and second set orbit crossing in a pattern that is characterized by said first set orbit passing radially outside of said second set orbit in first and second diametrically opposed sectors relative to said rope axis, and by said second set orbit passing radially outside of said first set orbit in third and fourth diametrically opposite sectors relative to said rope axis, wherein said third and fourth sectors are the complements of said first and second sectors; and take-up means mounted on said support and adapted for applying a take-up tension to rope formed from said strands and core member downstream of said braiding point so as to cause said strands to be withdrawn from the orbiting strand feed assemblies into said braiding point to form said rope.

2. The apparatus of claim 1, wherein there are a plurality of eight strand feed assemblies.

3. The apparatus of claim 1, wherein said elongate core member comprises a transversely flexible core member, and wherein said center core feed means comprises means for feeding said core member along said rope axis to said braiding point.

4. The apparatus of claim 1, wherein said plurality of strand feed assemblies comprises eight such assemblies and said transport means comprises means for transporting a first set of four of said assemblies in said first set orbit, and comprises means for transporting a second set of the remaining four of said assemblies in said second set orbit.

5. The apparatus of claim 4, wherein said transport means is further characterized by comprising means for transporting one of said first set of strand feed assemblies to the outermost extent of said first sector at the same time that said transport means transports another of said first set of assemblies to the diametrically opposite extent of the second sector so that the associated strands are in force opposing tension relationship.

6. The apparatus of claim 5, wherein said transport means is further characterized by including means for transporting said assemblies of said first set and second set such that strands from each of said sets are caused to be fed in pairs over an interiorally passing strand from the other set of said assemblies.

7. The apparatus of claim 1, wherein said transport means is further characterized by including means for transporting said first and second sets of said assemblies such that pairs of assemblies in said first and second sets alternately travel through said diametrically opposite sectors, whereby the outermost radial travel of the two sets of opposing sectors form the corners of the square shaped cross section of the resulting rope.

8. The apparatus of claim 1, wherein each of said strand feed assemblies comprises a bobbin of supply strand and a strand guide means defining the strand feed point of the assembly, and tensioning means for causing the tension of the strand fed from each assembly to increase to a maximum as the associated fed assembly travels to the outer perimeter of said diametrically opposing sectors.

9. The apparatus of claim 1, wherein said transport means comprises a plurality of four synchronously rotating coplanar transport disks arranged symmetrically about and normal to said rope axis, and having means for releasably engaging said strand feed assemblies to carry them in said first set orbit and said second set orbit.

10. The apparatus of claim 9, wherein said means for releasably engaging said assemblies comprises a plurality of cam operated latch means mounted around the perimeter of each of said transport dishes.

11. The apparatus of claim 9, wherein said means for releasably engaging said assemblies comprises radial slots extending inwardly from the perimeters of said disks.

12. The apparatus of claim 1, wherein said transport means comprises a plate having first and second orbital tracks encircling the rope axis and crossing at four cross over points for transporting said assemblies in said tracks in said first set orbit and said second set orbit.

13. The apparatus of claim 1, wherein each of said strand feed assemblies comprises a strand guide and support rod arranged to be transported by said transport means in an orientation parallel to and spaced at varying radial distances out from the rope axis, and a plurality of strand tensioning and guiding means mounted on said rod for tensioning the strand during transport of said assembly in said orbits, and for guiding the feed point of said strand from a location near an end of said rod distal from said transport means.

14. The apparatus of claim 11, wherein said strand feed assembly further comprises a means for dereeling supply bobbin and bobbin mounting arm connected to and supported by said rod.

15. The apparatus of claim 1, wherein there is an integer multiple of eight said strand feed assemblies.

16. A method for braiding rope having a generally square shaped cross section, comprising the steps of:

providing an elongate center core member to define a rope formation axis there along;

feeding plurality of rope strands toward a braiding point on said rope formation axis in which the plurality of strands are each fed from a supply bobbin;

transporting a first set of said supply bobbins in a first set orbit around the rope axis in one direction and transporting a second set of said supply bobbins in a second set orbit around the rope axis in the opposite direction wherein the first set and second set orbits are characterized by a crossing pattern in which the first set orbit passes radially outside of the second set orbit in first and second diametrically opposed sectors relative to the rope axis, and wherein the second set orbit passes radially outside of said first set orbit in third and fourth diametrically opposite sectors relative to the rope axis and wherein the third and fourth sectors are the complements of the first and second sectors; and applying take-off tension to rope formed downstream of said braiding point so as to cause the strands to be withdrawn from the orbiting supply spools into said braiding point to form said rope.

17. The method of claim 16 wherein said plurality of strand supply bobbins comprise at least eight such bobbins and said step of transporting said first and second sets of said bobbins comprise transporting a first set of one half of said bobbins in said first set orbit and transporting the remaining one half set of bobbins in said second set orbit.

18. The method of claim 16, wherein the step of providing said center core comprises the step of advancing an elongate core member along said rope formation axis and through said braiding point.

19. A braided rope having a generally square shaped cross section comprising:

an elongate center member extending along the center line of the rope; and a plurality of at least eight outer strands braided onto said center member in a pattern characterized by a generally square cross section in which each of the four corners are formed by adjacent, parallel outer strand segments extending diagonally to the center line in which each adjacent pair of said outer strand segments overlap an inner strand segment that extends diagonally oppositely to said adjacent pair of outer strand segments and that emerges midside between corners to form with other parallel like emerging strands the adjacent corner.

20. The braided rope of claim 19, wherein said center member has a tubular shape.

* * * * *